United States Patent [19]

Miano

[11] 3,963,251

[45] June 15, 1976

[54] ARTICULATED SHOE SOLE WITH UNIVERSAL SUPPORTIVE WHEEL

[76] Inventor: Paul P. Miano, Box 246 - Church St., Garyville, La. 70051

[22] Filed: July 1, 1975

[21] Appl. No.: 592,324

[52] U.S. Cl. ..... 280/11.1 BR; 36/8.3; 272/70; 280/11.3

[51] Int. Cl.[2] ..... A63C 17/08

[58] Field of Search ..... 280/11.1 BR, 11.1 R, 280/11.1 BT, 11.1 ET, 11.3, 11.2, 11.24, 87.04 A, 11.14, 11.15; 36/2.5 AE, 8.3; 272/70

[56] References Cited

UNITED STATES PATENTS

| | | | |
|---|---|---|---|
| 338,070 | 3/1886 | Heacock | 280/11.19 |
| 1,789,182 | 1/1931 | Klevstad | 280/11.15 |
| 1,984,989 | 12/1934 | Reed | 36/25 R |
| 2,998,260 | 8/1961 | Meyer | 280/11.3 |
| 3,010,732 | 11/1961 | Correll | 280/11.24 |
| 3,112,119 | 11/1963 | Sweet | 280/11.1 R |
| 3,224,785 | 12/1965 | Stevenson | 280/11.2 |
| 3,445,882 | 5/1969 | Miano | 16/21 |
| 3,871,672 | 3/1975 | Bardy | 280/11.21 |

*Primary Examiner*—M. H. Wood, Jr.
*Assistant Examiner*—David M. Mitchell
*Attorney, Agent, or Firm*—Clarence A. O'Brien; Harvey B. Jacobson

[57] ABSTRACT

A first body for attachment to the undersole portion of a shoe is provided and includes front and rear marginal portions. A second body for underlying the heel portion of a shoe is disposed to the rear of and swingably supported from the rear marginal portion of the first body for swinging relative thereto about a horizontal transverse axis. A spring is operably connected between the first and second bodies and functions to yieldingly upwardly swing the second body relative to the first body and the first body includes a downwardly facing bearing member journalled for rotation about a horizontal axis as well as an upstanding axis. With the first body suitably attached to the forward undersole portion of a shoe, the wearer of the shoe may propel himself with his other shoe and, upon transferring his weight to the shoe from which the first body is supported, roll across a suitable supporting surface. The second body, upon upward flexing of the heel portion of the associated shoe, is swung upwardly out of engagement with the supporting surface, but may be downwardly displaced by the heel of the associated shoe into engagement with the supporting surface for braking action.

7 Claims, 6 Drawing Figures

ARTICULATED SHOE SOLE WITH UNIVERSAL SUPPORTIVE WHEEL

BACKGROUND OF THE INVENTION

Various forms of roller skates and modified skate constructions have been heretofore designed. Some forms of roller skate shoes include spherical bearings such as that disclosed in U.S. Pat. No. 1,271,891, while others include caster wheels such as those disclosed in U.S. Pat. No. 1,984,989. Still further, spinner attachments for the sole portions of shoes have been previously provided for various forms of dancing and examples of two forms of spinner attachments are disclosed in U.S. Pat. Nos. 3,091,043 and 3,204,348. Finally, toe and ballet dancing shoes have also been provided with supportive roller means such as those disclosed in U.S. Pat. Nos. 2,400,534 and 3,010,732. However, the structures disclosed in the above mentioned patents have not been designed for varied usage on a single shoe of the wearer and in conjunction with a more conventional shoe on the other foot of the wearer to be used for propulsion purposes.

BRIEF DESCRIPTION OF THE INVENTION

The shoe construction of the instant invention has been designed for single use on one foot of the user with a more conventional shoe construction being utilized on the other foot of the user. The instant invention provides a universally supported wheel for support of the associated shoe therefrom and also includes brake structure for braking independently of the wheel. The user of the shoe construction utilizes a more conventional shoe on his other foot for propulsion purposes and the shoe construction of the instant invention may be used as a rolling support for the user when the weight of the user is transferred to the shoe construction. The shoe construction of the instant invention may further be utilized as a support while the user is spinning and many different forms of graceful maneuvers may be carried out through the utilization of the shoe construction of the instant invention.

The main object of this invention is to provide a shoe construction to be worn on one foot of the user in conjunction with a more conventional shoe on the outer foot of the user and with the shoe construction of the instant invention provided with a roller support structure journalled for rotation about a horizontal axis from a roller support in turn mounted from the shoe construction for rotation about an upstanding axis.

Another object of this invention is to provide the shoe construction of the instant invention with a brake structure for selective engagement with the supportive surface for the shoe construction and which is automatically moved out of engagement with the supportive surface when the user of the shoe construction transfers his weight to the sole portion of the shoe construction.

Another important object of this invention is to provide a shoe construction in accordance with the present invention and including structural features whereby the operating components of the invention may be readily transferred from one shoe construction to another.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
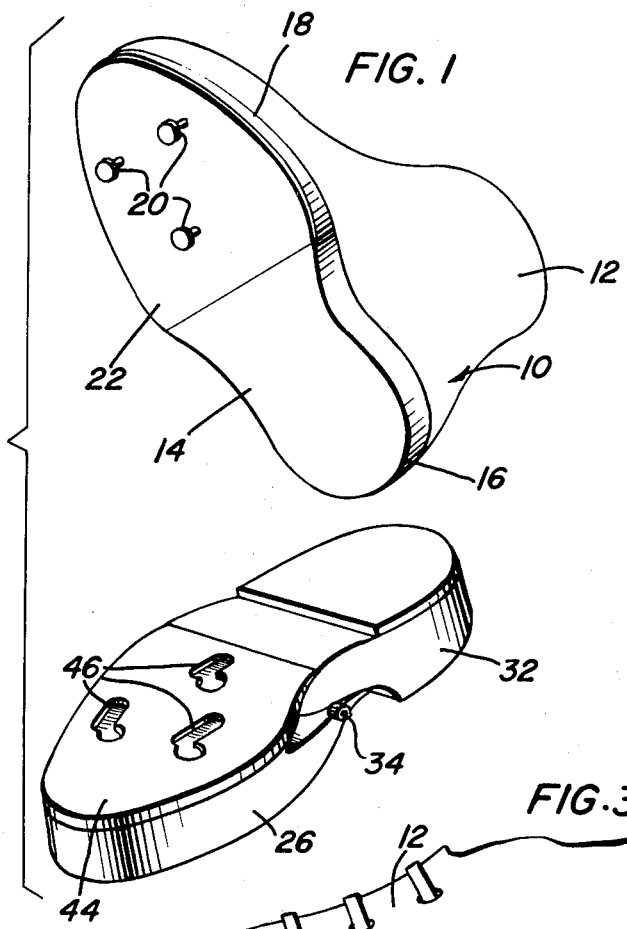
FIG. 1 is an exploded perspective view of the shoe construction of the instant invention.
Figure 2:
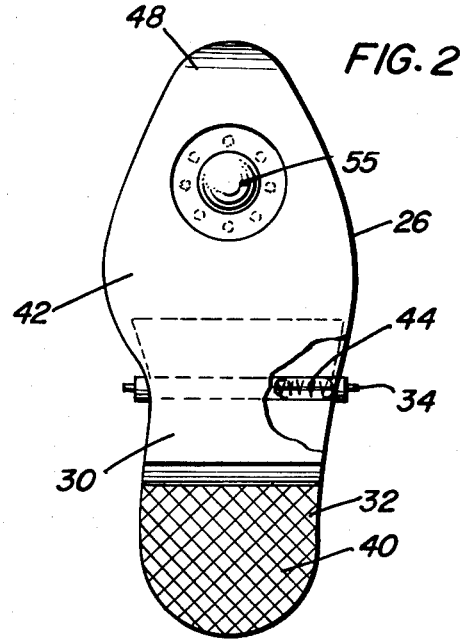
FIG. 2 is a bottom plan view of the shoe construction with portions thereof being broken away.

Referring now more specifically to the drawings the numeral 10 generally designates a shoe construction including an upper 12 and a flexible (bendable) sole 14. The sole 14 includes a heel portion 16 and a toe portion 18. The toe portion 18 includes three depending headed shank members 20 carried by a rigid plate portion 22 secured to the underside of the toe portion 18 in any convenient manner such as by adhesive 24.

Figure 3:
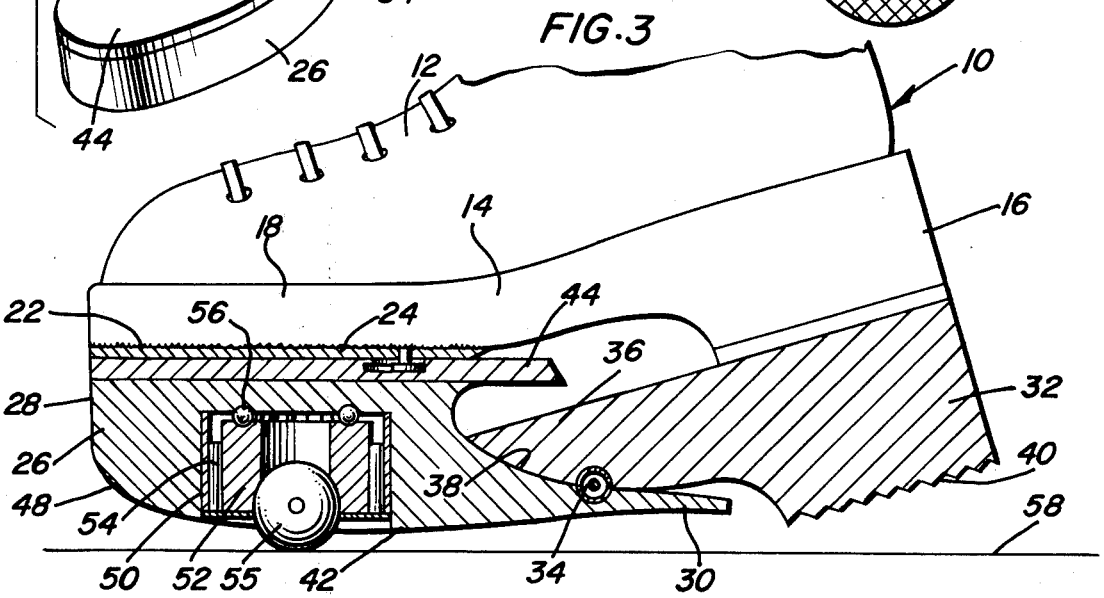
FIG. 3 is an enlarged fragmentary longitudinal vertical sectional view taken substantially upon the plane passing through the longitudinal center line of the shoe construction.
Figure 4:
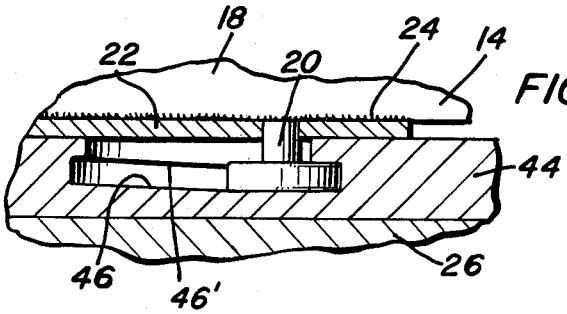
FIG. 4 is a further enlarged fragmentary vertical sectional view illustrating the manner in which the removable operative components of the shoe construction are secured to the undersole of the shoe portion of the invention.
Figure 5:
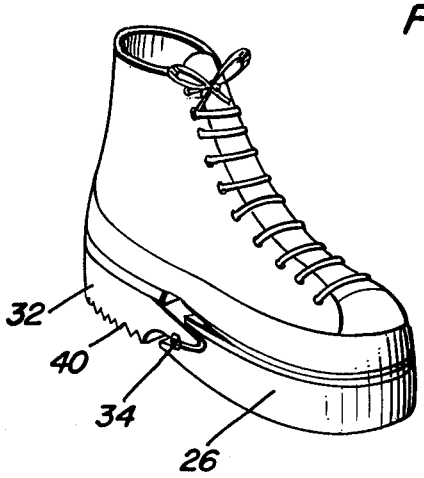
FIG. 5 is a perspective view of the shoe construction.

Referring now more specifically to FIGS. 1, 3 and 4 of the drawings it may be seen that the shoe construction 10 includes a first undersole body 26 including front and rear marginal portions 28 and 30 and a second undersole body 32 hingedly supported as at 34 to the rear marginal portion 30 of the front or first undersole body 26 for limited oscillation relative thereto. The second body is oscillatable relative to the first undersole body 26 about a horizontal transverse axis between a raised upper position such as that illustrated in FIG. 3 of the drawings with the forward tongue portion 36 of the body 32 abutted against the upper surface portion 38 of the body 26 at the rear portion thereof and a lowered position with the serrated undersurface 40 of the second body 32 projecting at least slightly below the undersurface 42 of the body 26, a coil spring 44 being suitably connected between the bodies 26 and 32 and yieldingly biasing the second body 32 to the position thereof illustrated in FIG. 3.

The upper portion of the body 26 includes a rigid plate 44 equipped with keyhole-type slots 46 formed therein including inclined wedge surfaces 46'. The slots 46 receive the headed shank portions 20 therein and upon movement of the headed shank portions to the blind ends of the slots the rigid plate 44 is securely removably clamped to the rigid plate portion 22.

The forward portion of the undersurface 42 of the body 26 curves upwardly as at 48 and that portion of the body 26 which would underlie the ball portion of a foot disposed within the shoe construction 10 has a downwardly opening recess 50 formed therein in which a generally cylindrical body 52 is rotatably journalled for rotation about an upstanding axis by means of journal bearings 54 and thrust bearings 56. The body 52 rotatably journals a spherical wheel member 55 in the lower end thereof for rotation about a horizontal axis extending generally diametrically of the cylindrical body 52 and the combination including the components 50, 52, 54, 55 and 56 is similar to that structure disclosed in my U.S. Pat. No. 3,445,882.

In operation, the body 26 with the rigid plate 44 secured thereto may be removably supported from any suitable shoe construction equipped with the equivalent of the rigid plate portion 22. The user of the invention utilizes the shoe construction 10 on only one foot and a more conventional shoe construction on the other foot for propelling purposes. With the body 26 removably secured to the rigid plate portion 22 in the manner illustrated in FIG. 3 the user may then propel himself with his conventional shoe and transfer his weight from the conventional shoe to the shoe construction 10 for rolling over the support surface 58 upon which the roller 55 is disposed. If it is desired, a cylindrical roller may be used in lieu of the substantially spherical roller 55 and the second or brake body 32 is automatically raised from engagement with the surface 58 whenever the user transfers his weight to the toe portion 18 of the sole 14. However, should the user desire to brake his movement over the surface 58, it is merely necessary for him to lower the heel portion 16 of the shoe construction 10 so as to force the serrated surface 40 of the second body 32 down into frictional engagement with the surface 58.

Figure 6:
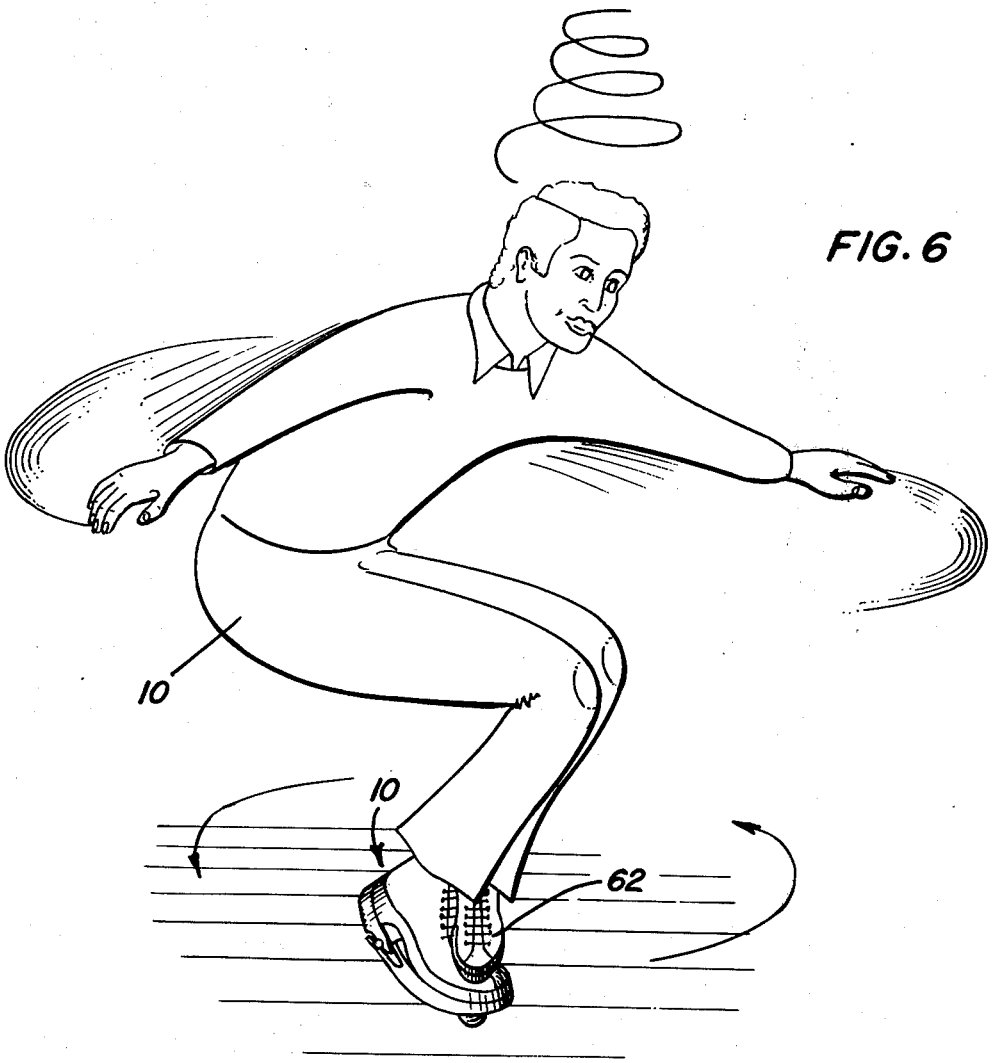
FIG. 6 is a perspective view of a user of the shoe construction executing a spin.

FIG. 6 of the drawings indicates the manner in which the user 60 may execute a high speed spin when the shoe construction 10 is worn on the right foot. If the shoe construction 10 is worn on the right foot then the conventional shoe 62 worn on the left foot may have the underside of the toe portion thereof placed on the upper side of the toe portion of the upper 12 of the shoe construction 10 during a spinning maneuver. Of course, the shoe construction 10 may be a right shoe or a left shoe.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a shoe including an upper and an underlying flexible sole having front and rear toe and heel portions, a first body attached to and underlying the under surface of said toe portion and including front and rear marginal portions, a second body including front and rear marginal portions underlying said heel portion for abutment therewith, attaching means removably stationarily attaching said first body to said toe portion, pivot means pivotally attaching the front marginal portion of said second body to the rear marginal portion of the first body for limited pivotal movement of said second body relative to said first body about a fixed horizontal transverse axis, spring means connected between said bodies yieldingly urging said second body, in an angular direction relative to said first body, to swing said second body, rearward of said axis, upwardly into abutting engagement with said heel portion, said first body including a single downwardly facing bearing member journaled from said first body for rotation about a horizontal axis as well as an upstanding axis, said second body including at least a rear undersurface portion adapted for movement braking frictional engagement with a horizontal surface upon which said bearing member is disposed and being free of direct attachment to said shoe, whereby said shoe sole heel portion may be elevated above the upper limit of swinging movement of the rear portion of said second body.

2. The combination of claim 1 wherein said first body includes a bearing support rotatably supported therefrom for rotation about an upstanding axis, said bearing member being journalled from said bearing support for rotation about a horizontal axis fixed relative to said bearing support.

3. The combination of claim 1 wherein said bearing member comprises a substantially spherical bearing member.

4. The combination of claim 1 including a rigid mounting plate portion attached to the undersurface of the forward portion of said sole, said attaching means including coacting means carried by mounting plate portion and said first body releasably clampingly supporting said first body from said mounting plate portion.

5. The combination of claim 4 wherein said mounting plate portion includes an undersurface downwardly from which a plurality of spaced headed shank members project, said first body including an upper surface portion in which a plurality of key-shaped slots including wedge surfaces are formed and in which the lower headed ends of said shank members are removably tightly interengaged, said slots and shank members comprising said coacting means.

6. The combination of claim 5 wherein said first body includes a bearing support rotatably supported therefrom for rotation about an upstanding axis, said bearing member being journalled from said bearing support for rotation about a horizontal axis fixed relative to said bearing support.

7. The combination of claim 6 wherein said bearing member comprises a substantially spherical bearing member.

* * * * *